US012290742B2

(12) United States Patent
Miyakoshi et al.

(10) Patent No.: US 12,290,742 B2
(45) Date of Patent: May 6, 2025

(54) SPORTS GLOVE

(71) Applicant: MIZUNO CORPORATION, Osaka (JP)

(72) Inventors: Kosuke Miyakoshi, Osaka (JP); Hiroshi Nagao, Osaka (JP); Norikazu Ninomiya, Osaka (JP)

(73) Assignee: MIZUNO CORPORATION, Osaka (JP)

( * ) Notice: Subject to any disclaimer, the term of this patent is extended or adjusted under 35 U.S.C. 154(b) by 0 days.

(21) Appl. No.: 18/376,108

(22) Filed: Oct. 3, 2023

(65) Prior Publication Data

US 2024/0108088 A1 Apr. 4, 2024

(30) Foreign Application Priority Data

Oct. 3, 2022 (JP) ..... 2022-159725

(51) Int. Cl.
*A63B 71/14* (2006.01)
*A41D 19/015* (2006.01)

(52) U.S. Cl.
CPC ..... *A63B 71/143* (2013.01); *A41D 19/01582* (2013.01); *A41D 2400/80* (2013.01); *A41D 2600/10* (2013.01)

(58) Field of Classification Search
CPC ..... A63B 71/143; A63B 71/146; A41D 19/01582; A41D 2400/80; A41D 2400/10; A41D 19/0096; A41D 19/0082; A41D 19/0015
See application file for complete search history.

(56) References Cited

U.S. PATENT DOCUMENTS

| | | | | |
|---|---|---|---|---|
| 5,195,188 | A | 3/1993 | Bourdeau et al. | |
| 6,389,601 | B2 | 5/2002 | Kleinert | |
| 2002/0042940 | A1* | 4/2002 | Kuroda | A63B 71/146 2/161.1 |
| 2007/0150998 | A1 | 7/2007 | Atherton | |

FOREIGN PATENT DOCUMENTS

| | | | |
|---|---|---|---|
| CN | 205695885 | U | 11/2016 |
| JP | H0226522 | Y2 | 7/1990 |
| JP | H04104882 | U | 9/1992 |
| JP | H06121859 | A | 5/1994 |

(Continued)

*Primary Examiner* — Khoa D Huynh
*Assistant Examiner* — Erick I Lopez
(74) *Attorney, Agent, or Firm* — TROUTMAN PEPPER LOCKE LLP; James E. Schutz; Korbin M. Blunck

(57) ABSTRACT

A sports glove includes an index finger portion, a middle finger portion, a ring finger portion, and a little finger portion, as well as a back portion and a first resistance portion. The back portion is connected to the index finger portion, the middle finger portion, the ring finger portion, and the little finger portion. The back portion covers a back of the wearer's hand. The first resistance portion has flexibility. The first resistance portion is disposed on at least one selected from the group consisting of the back portion, the ring finger portion, and the little finger portion such that when the index finger, the middle finger, the ring finger, and the little finger are bent, a magnitude of bending resistance applied to the little finger or the ring finger is greater than that applied to the middle finger or the index finger.

5 Claims, 7 Drawing Sheets

(56) References Cited

FOREIGN PATENT DOCUMENTS

| | | | |
|---|---|---|---|
| JP | H08291405 | A | 11/1996 |
| JP | H09182825 | A | 7/1997 |
| JP | H1157107 | A | 3/1999 |
| JP | 200265928 | A | 3/2002 |
| JP | 3926731 | B2 | 6/2007 |
| JP | 4252964 | B2 | 4/2009 |
| JP | 4510055 | B2 | 7/2010 |
| JP | 3209002 | U | 3/2017 |
| JP | 6345017 | B2 | 6/2018 |

* cited by examiner

SPORTS GLOVE

CROSS REFERENCE TO RELATED APPLICATIONS

This non-provisional application is based on, and claims priority to, Japanese Patent Application No. 2022-159725 filed on Oct. 3, 2022 with the Japan Patent Office, the entire contents of which are hereby incorporated by reference.

BACKGROUND OF THE INVENTION

Field of the Invention

The present invention relates to a sports glove.

Description of the Background Art

Conventionally, in a sports glove used in a competition for gripping a spherical body, a rod-shaped body, or the like, in order to improve a fit feeling of a wearer with respect to a hand and to improve a gripping state, a measure such as arranging a material having excellent stretchability has been made. Japanese Patent Laying-Open No. 2002-65928 discloses a sports glove having a band disposed on at least one of a little finger portion, a ring finger portion, and a middle finger portion. In Japanese Patent Laying-Open No. 2002-65928, by providing such a band, when a target object is gripped, at least one of a little finger, a ring finger, and a middle finger is tightened by the band, so that the target object can be gripped firmly with the little finger, the ring finger, and the middle finger rather than the thumb and the index finger.

However, in the above-described sports glove, there is room for improvement in the gripping state of the target object.

SUMMARY OF THE INVENTION

The present invention has been made to solve the above-described problems, and an object of the present invention is to provide a sports glove capable of realizing a good gripping state when the wearer grips a target object.

A sports glove according to the present disclosure includes an index finger portion, a middle finger portion, a ring finger portion, and a little finger portion, a back portion, and a first resistance portion. The index finger portion, the middle finger portion, the ring finger portion, and the little finger portion are capable of respectively receiving the index finger, the middle finger, the ring finger, and the little finger of a hand of a wearer. The back portion is connected to the index finger portion, the middle finger portion, the ring finger portion, and the little finger portion. The back portion covers a back of the wearer's hand. The first resistance portion has flexibility. The first resistance portion is disposed on at least one selected from the group consisting of the back portion, the ring finger portion, and the little finger portion such that when the wearer bends the index finger, the middle finger, the ring finger, and the little finger respectively received by the index finger portion, the middle finger portion, the ring finger portion, and the little finger portion, a magnitude of bending resistance applied to the little finger or the ring finger is greater than a magnitude of bending resistance applied to the middle finger or the index finger.

According to the above, it is possible to obtain a sports glove capable of realizing a good gripping state when the wearer grips the target object.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
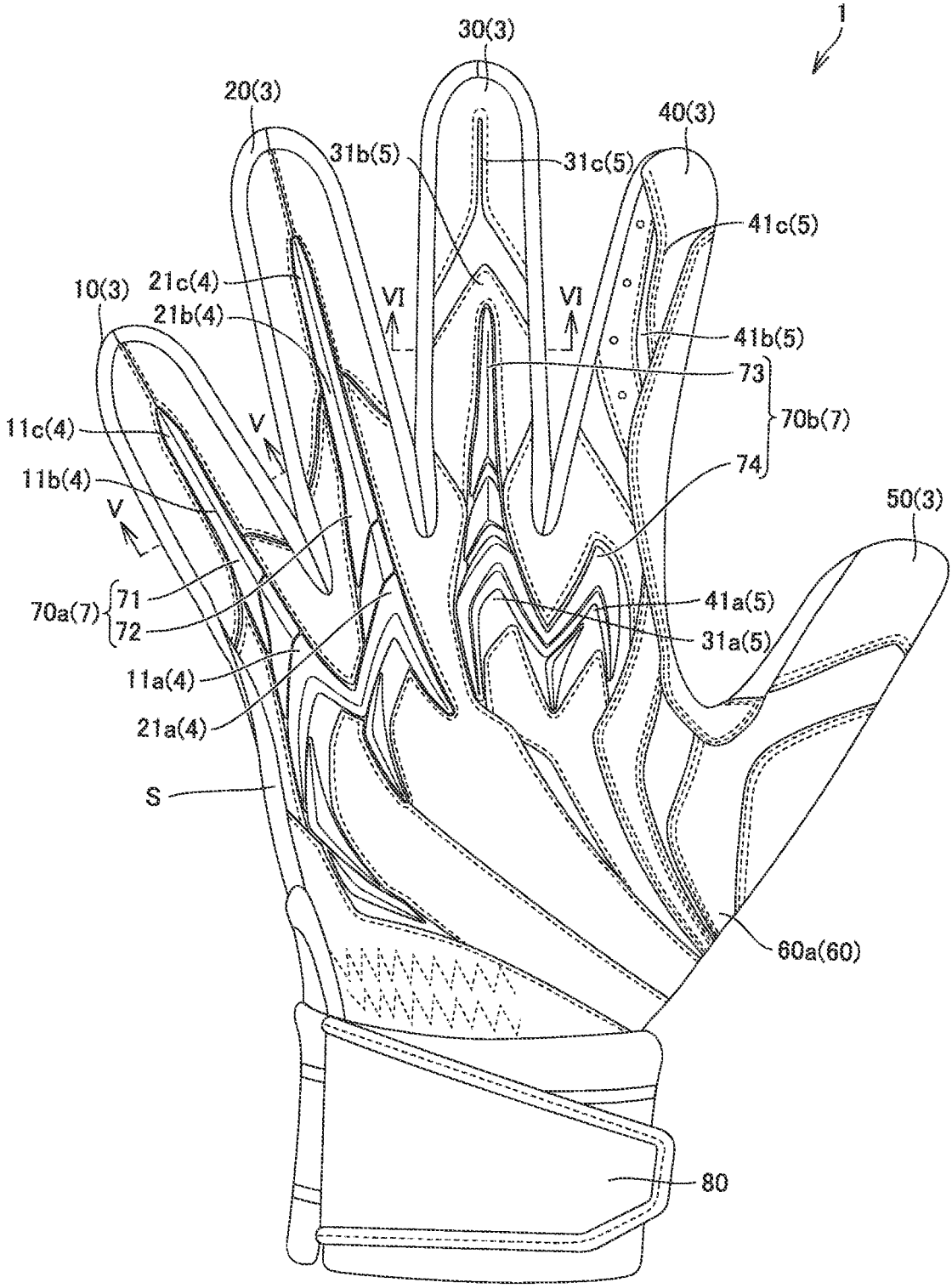
FIG. 1 is a plan view of a sports glove according to one embodiment.

Hereinafter, embodiments of the present invention will be described. Note that, unless otherwise specified, the same or corresponding parts in the following drawings are denoted by the same reference numerals, and the description thereof will not be repeated.

EMBODIMENTS

<Configuration of Sports Glove>

Figure 2:
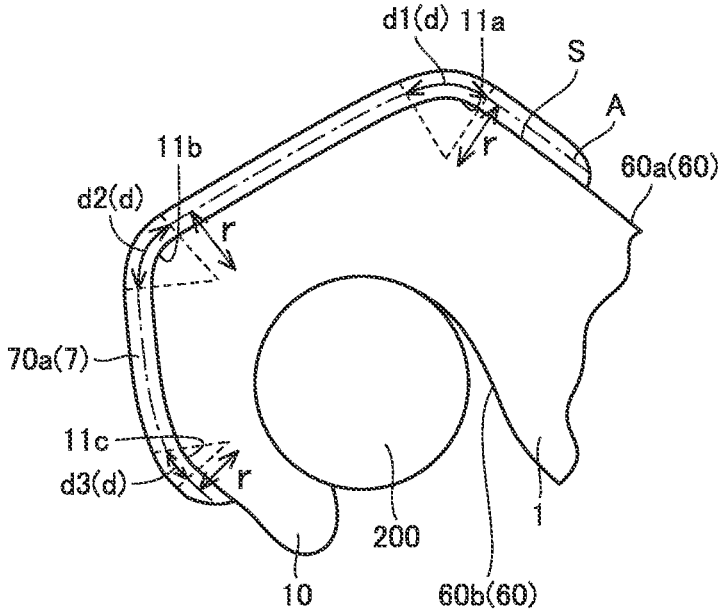
FIG. 2 is a side view schematically showing a state in which a bat is gripped with a sports glove according to one embodiment being worn.
Figure 3:
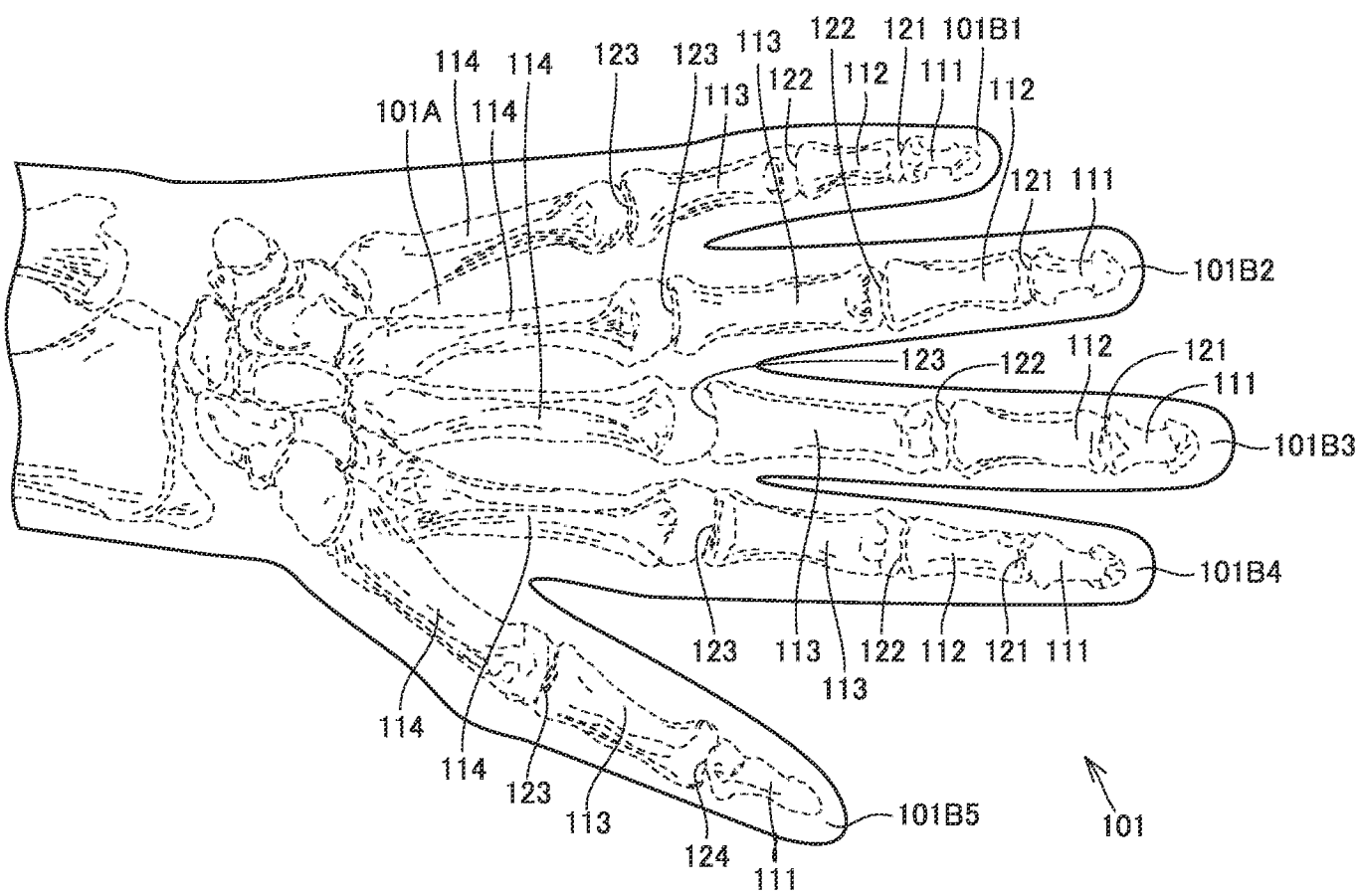
FIG. 3 is a schematic view schematically illustrating an appearance and a skeleton of a left hand of a wearer in a case where the left hand is viewed from a back side of the wearer's hand.

FIG. 1 is a plan view of a sports glove 1 according to one embodiment. FIG. 2 is the side view schematically showing the state where a bat 200 is gripped with sports glove 1 according to the embodiment as viewed from a little finger side. FIG. 3 is the schematic view schematically illustrating the appearance and the skeleton of left hand 101 of the wearer in a case where left hand 101 is viewed from a back side of the wearer's hand.

Sports gloves 1 shown in FIGS. 1 and 2 are, for example, a baseball glove 1, and is worn during batting. Sports glove 1 shown in FIG. 1 is configured to be able to receive one hand of a wearer. The wearer with glove 1 fitted in his/her hand grips, for example, a root side of the grip of bat 200 with one hand.

Sports glove 1 shown in FIG. 1 is a left-hand sports glove 1 to be worn on left hand 101. Note that, sports glove 1 in the present embodiment may be a right-hand sports glove 1 to be worn on a right hand. Sports glove 1 for right hand is configured to be mirror-symmetrical to sports glove 1 for left hand. In addition, a pair of left-hand sports glove 1 and the right hand sports glove described above may be worn on both hands of the wearer.

As shown in FIG. 1, sports glove 1 mainly includes a finger portion 3, a back portion 60*a*, a palm portion 60*b*, a belt 80, and a resistance portion 7. Resistance portion 7 includes a first resistance portion 70*a* and a second resistance portion 70*b*. When glove 1 is fitted into the wearer's hand, back portion 60*a* covers a back 101A of the wearer's hand. When glove 1 is fitted into the wearer's hand, palm portion 60*b* covers the wearer's palm. In other words, when glove 1 is fitted into the wearer's hand, back portion 60*a* and palm portion 60*b* are disposed so as to sandwich the wearer's hand. Back portion 60*a* and palm portion 60*b* are connected to finger portion 3. Back portion 60*a* and palm portion 60*b* are connected to a wrist portion on a side opposite to a side connected to finger portion 3. An end of the wrist portion is an opening portion for allowing the wearer's hand to enter an inside of sports glove 1. Belt 80 is disposed on the wrist portion. Materials of finger portion 3, back portion 60*a*, palm portion 60*b*, the wrist portion, and belt 80 may be, for example, natural leather.

Finger portion 3 includes a thumb portion 50, an index finger portion 40, a middle finger portion 30, a ring finger portion 20, and a little finger portion 10. In other words, back portion 60*a* and palm portion 60*b* are connected to thumb portion 50, index finger portion 40, middle finger portion 30, ring finger portion 20, and little finger portion 10. Thumb portion 50, index finger portion 40, middle finger portion 30, ring finger portion 20, and little finger portion 10 can receive a thumb 101B5, an index finger 101B4, a middle finger 101B3, a ring finger 101B2, and a little finger 101B1 of the wearer's hand, respectively. Thumb portion 50, index finger portion 40, middle finger portion 30, ring finger portion 20, and little finger portion 10 are independent of each other.

With reference to FIGS. 1 and 3, a positional relationship between glove 1 and the bone of left hand 101 of the wearer will be described. FIG. 3 illustrates the appearance and the skeleton of left hand 101 in a case where the wearer's left hand 101 is viewed from a back 101A side of the wearer's hand.

As illustrated in FIG. 3, in each of index finger 101B4, middle finger 101B3, ring finger 101B2, and little finger 101B1, a distal phalanx 111, a middle phalanx 112, a proximal phalanx 113, and a metacarpal bone 114 are arranged in an order from a fingertip side. Distal phalanx 111 and middle phalanx 112 are connected to each other with a distal interphalangeal joint 121 interposed therebetween. Middle phalanx 112 and proximal phalanx 113 are connected with a proximal interphalangeal joint 122 interposed therebetween. Proximal phalanx 113 and metacarpal bone 114 are connected with a metacarpophalangeal joint 123 interposed therebetween. In thumb 101B5, distal phalanx 111, proximal phalanx 113, and metacarpal bone 114 are arranged in this order from the fingertip side. In thumb 101B5, distal phalanx 111 and proximal phalanx 113 are connected with a first interphalangeal joint 124, and proximal phalanx 113 and metacarpal bone 114 are connected with metacarpophalangeal joint 123 interposed therebetween.

Back portion 60*a*, ring finger portion 20, and little finger portion 10 include a first joint portion 4. First joint portion 4 includes a first metacarpophalangeal joint portion 11*a*, a second metacarpophalangeal joint portion 21*a*, a first proximal interphalangeal joint portion 11*b*, a first distal interphalangeal joint portion 11*c*, a second proximal interphalangeal joint portion 21*b*, and a second distal interphalangeal joint portion 21*c*. First metacarpophalangeal joint portion 11*a* covers metacarpophalangeal joint 123 of little finger 101B1 of the wearer's hand wearing glove 1. Second metacarpophalangeal joint portion 21*a* covers metacarpophalangeal joint 123 of ring finger 101B2 of the wearer's hand wearing glove 1. First proximal interphalangeal joint portion 11*b* covers proximal interphalangeal joint 122 of little finger 101B1 of the wearer's hand wearing glove 1. First distal interphalangeal joint portion 11*c* covers distal interphalangeal joint 121 of little finger 101B1 of the wearer's hand wearing glove 1. Second proximal interphalangeal joint portion 21*b* covers proximal interphalangeal joint 122 of ring finger 101B2 of the wearer's hand wearing glove 1. Second distal interphalangeal joint portion 21*c* covers distal interphalangeal joint 121 of ring finger 101B2 of the wearer's hand wearing glove 1.

Back portion 60*a*, index finger portion 40, and middle finger portion 30 include a second joint portion 5. Second joint portion 5 includes a third metacarpophalangeal joint portion 31*a*, a fourth metacarpophalangeal joint portion 41*a*, a third proximal interphalangeal joint portion 31*b*, a third distal interphalangeal joint portion 31*c*, a fourth proximal interphalangeal joint portion 41*b*, and a fourth distal interphalangeal joint portion 41*c*. Third metacarpophalangeal joint portion 31*a* covers metacarpophalangeal joint 123 of middle finger 101B3 of the wearer's hand wearing glove 1. Fourth metacarpophalangeal joint portion 41*a* covers metacarpophalangeal joint 123 of index finger 101B4 of the wearer's hand wearing glove 1. Third proximal interphalangeal joint portion 31*b* covers proximal interphalangeal joint 122 of middle finger 101B3 of the wearer's hand wearing glove 1. Third distal interphalangeal joint portion 31*c* covers distal interphalangeal joint 121 of middle finger 101B3 of the wearer's hand wearing glove 1. Fourth proximal interphalangeal joint portion 41*b* covers proximal interphalangeal joint 122 of index finger 101B4 of the wearer's hand wearing glove 1. Fourth distal interphalangeal joint portion 41*c* covers distal interphalangeal joint 121 of index finger 101B4 of the wearer's hand wearing glove 1.

In other words, first proximal interphalangeal joint portion 11*b* and first distal interphalangeal joint portion 11*c* are disposed on a surface S of little finger portion 10. Second proximal interphalangeal joint portion 21*b* and second distal interphalangeal joint portion 21*c* are disposed on surface S of ring finger portion 20. Third proximal interphalangeal joint portion 31*b* and third distal interphalangeal joint portion 31*c* are disposed on surface S of middle finger portion 30. Fourth proximal interphalangeal joint portion 41*b* and fourth distal interphalangeal joint portion 41*c* are disposed on surface S of index finger portion 40. First metacarpophalangeal joint portion 11*a*, second metacarpophalangeal joint portion 21*a*, third metacarpophalangeal joint portion 31*a*, and fourth metacarpophalangeal joint portion 41*a* are disposed on surface S of back portion 60*a*. By fitting glove 1 configured as described above into the hand, the wearer grips the target object with the hand wearing glove 1 as illustrated in FIG. 2.

As shown in FIGS. 1 and 2, resistance portion 7 is disposed on surface S of back portion 60*a* and finger portion 3. Specifically, resistance portion 7 is disposed on first joint portion 4 and second joint portion 5 that cover the joint of the wearer's hand. Resistance portion 7 has flexibility. By providing such resistance portion 7, when the wearer grasps the target object with the hand fitted with glove 1, a bending resistance R is applied to each finger of the hand fitted with glove 1.

Bending resistance R corresponds to a bending moment M generated in resistance portion 7 when the wearer bends index finger 101B4, middle finger 101B3, ring finger 101B2, and little finger 101B1 respectively received by index finger portion 40, middle finger portion 30, ring finger portion 20, and little finger portion 10. As illustrated in FIG. 2, when the wearer grips bat 200 with the hand into which glove 1 is fitted in a side view in which the state in which the wearer wears sports glove 1 and grips bat 200 is viewed from a little finger 101B1 side, a strain d is generated in resistance portion 7. Since resistance portion 7 has flexibility, bending moment M is generated when strain d is generated in resistance portion 7. Bending moment M generated in resistance portion 7 is calculated by multiplying the Young's modulus E, a section modulus Z, and the strain amount of resistance portion 7. Alternatively, bending moment M may be calculated by multiplying a rigidity EI of resistance portion 7 by a curvature 1/r (a reciprocal of a radius of curvature r illustrated in FIG. 2). Radius of curvature r is a distance from a center of curvature of strain d generated in the resistance portion when the wearer's finger is bent to a central axis A. Central axis A is a line passing through a position half the height of resistance portion 7. In other words, the wearer applies a force to bend the finger so that bending moment M is generated in resistance portion 7. Note that, strain amounts d1, d2, and d3 generated in resistance portion 7 covering metacarpophalangeal joint 123, proximal interphalangeal joint 122, and distal interphalangeal joint 121 correspond to amounts of change in a length of resistance portion 7, respectively, when the finger of the wearer changes from a stretched state to a bent state. Therefore, strain amounts d1, d2, and d3 can be determined by marking resistance portion 7 and measuring a displacement amount of the marking using a measuring instrument such as a measure. In addition, the radius of curvature is a distance between the center of curvature and central axis A when the finger is bent, and can be determined by measuring the distance using the measuring instrument.

First resistance portion 70*a* is disposed on surface S of back portion 60*a*, ring finger portion 20, and little finger portion 10. Second resistance portion 70*b* is disposed on surface S of back portion 60*a*, middle finger portion 30, and index finger portion 40. First resistance portion 70*a* includes a little finger resistance portion 71 and a ring finger resistance portion 72. Second resistance portion 70*b* includes a middle finger resistance portion 73 and an index finger resistance portion 74. Little finger resistance portion 71 is arranged on surface S of back portion 60*a* and little finger portion 10. Ring finger resistance portion 72 is disposed on surface S of back portion 60*a* and ring finger portion 20. Middle finger resistance portion 73 is disposed on surface S of back portion 60*a* and middle finger portion 30. Index finger resistance portion 74 is disposed on surface S of back portion 60*a* and index finger portion 40. Little finger resistance portion 71 and ring finger resistance portion 72 may be integrally connected at back portion 60*a*, or may be disposed separately from each other. Middle finger resistance portion 73 and index finger resistance portion 74 may be integrally connected by back portion 60*a*, or may be disposed separately from each other. By providing such resistance portion 7, it is also possible to suppress generation of slack and wrinkles in palm portion 60*b*.

Here, a feature of sports glove 1 according to the present embodiment is that, resistance portion 7 is configured such that a load applied to little finger 101B1 and ring finger 101B2 in the hand wearing glove 1 becomes larger than the load applied to index finger 101B4 and middle finger 101B3 in the hand wearing glove 1 when the wearer grips the target object with the hand wearing glove 1.

In general, when the target object is gripped, the target object tends to be gripped so as to be tightened with index finger 101B4 having a large force (hereinafter referred to as finger force) generated by the finger. However, the inventors have found that it is effective to consciously grip the target object with a finger having a small finger force in order to realize a good gripping state with excellent operability with respect to the target object. The finger force of middle finger 101B3, ring finger 101B2, and little finger 101B1 is smaller than the finger force of index finger 101B4. On the other hand, when the load is applied to middle finger 101B3, ring finger 101B2, and little finger 101B1, it is possible to turn attention to these fingers, and as a result, it is possible to reliably grip the target object with these fingers. Therefore, resistance portion 7 is provided such that bending resistance R to be applied to at least one of middle finger 101B3, ring finger 101B2, and little finger 101B1 is greater than bending resistance R to be applied to index finger 101B4 when the target object is gripped with the hand with glove 1 fitted, whereby a good gripping state with respect to the target object can be realized.

Figure 4:
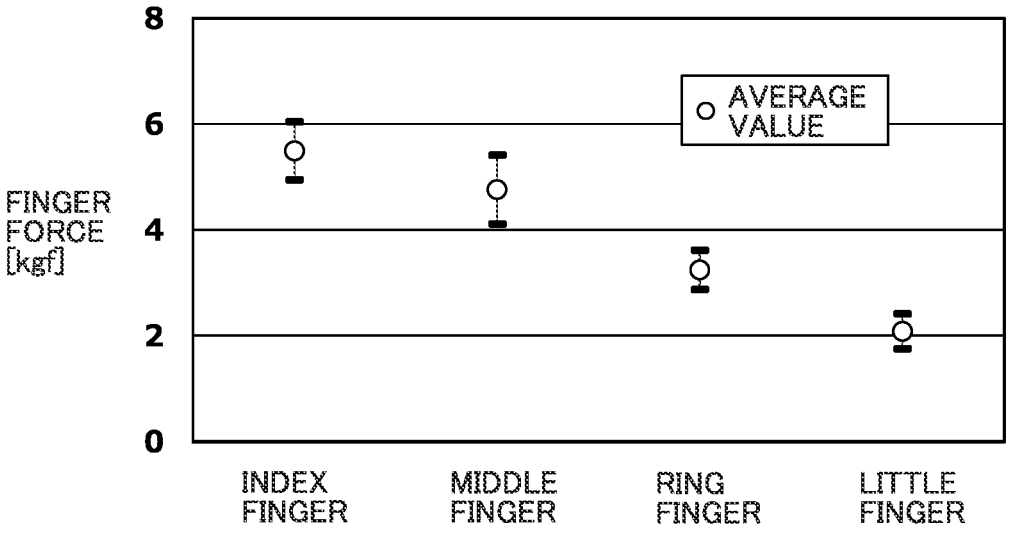
FIG. 4 is a graph showing finger forces of respective fingers of adult males.

FIG. 4 is a graph showing an average value and a standard deviation of finger forces of respective fingers when the finger forces of measurement target fingers of 10 adult males are measured 5 times. Note that, the finger force of each finger shown in FIG. 4 was measured using a hydraulic pinch gauge manufactured by SAKAI Medical Co., Ltd. In FIG. 4, a vertical axis represents a finger force (unit: kgf) corresponding to each finger. An upper limit of the graph corresponds to a value obtained by adding the standard deviation to the average value. A lower limit of the graph corresponds to a value obtained by subtracting the standard deviation from the average value. The measurement target fingers are index finger 101B4, middle finger 101B3, ring finger 101B2, and little finger 101B1. As can be seen from FIG. 4, an average value of the finger forces is larger in the order of index finger 101B4, middle finger 101B3, ring finger 101B2, and little finger 101B1. Therefore, in order to realize a good gripping state of the target object, it is considered preferable to dispose resistance portion 7 so that the load applied to little finger 101B1, ring finger 101B2, middle finger 101B3, and index finger 101B4 is larger in this order in order to make the finger having a relatively small finger force more conscious.

On the other hand, a difference between an average value of the finger forces of middle finger 101B3 and an average value of the finger forces of index finger 101B4 is less than 1 kgf. In particular, considering the standard deviation, it can be seen that a value obtained by adding the standard deviation to the average value of the finger forces of middle finger 101B3 is larger than a value obtained by subtracting the standard deviation from the average value of the finger forces of index finger 101B4. In other words, it is considered that there are a certain number of cases where the finger force of middle finger 101B3 is larger than the finger force of index finger 101B4. However, a value obtained by subtracting the standard deviation from the average value of the finger forces of middle finger 101B3 is larger than a value obtained by adding the standard deviation to the average value of the finger forces of ring finger 101B2. In addition, a value obtained by subtracting the standard deviation from the average value of the finger forces of ring finger 101B2 is larger than a value obtained by adding the standard deviation to the average value of the finger forces of little finger 101B1. From this, in order to realize a good gripping state of the target object, it is considered more preferable to consciously grip the target object with ring finger 101B2 and little finger 101B1 by turning their attention to these fingers. Therefore, in order to realize a good gripping state of the target object, it is preferable to dispose resistance portion 7 such that the load applied to ring finger 101B2 and little finger 101B1 is larger than the load applied to index finger 101B4 and middle finger 101B3.

With reference to FIG. 1, an arrangement position of resistance portion 7 will be described. As illustrated in FIG. 1, little finger resistance portion 71 is disposed on surfaces S of back portion 60*a* and little finger portion 10 so as to straddle each of first metacarpophalangeal joint portion 11*a*, first proximal interphalangeal joint portion 11*b*, and first distal interphalangeal joint portion 11*c*. Little finger resistance portion 71 extends from above first metacarpophalangeal joint portion 11*a* to above first distal interphalangeal joint portion 11*c* with above first proximal interphalangeal joint portion 11*b* interposed therebetween. Ring finger resistance portion 72 is disposed on surfaces S of back portion 60*a* and little finger portion 10 so as to straddle each of second metacarpophalangeal joint portion 21*a*, second proximal interphalangeal joint portion 21*b*, and second distal interphalangeal joint portion 21*c*. Ring finger resistance portion 72 extends from above second metacarpophalangeal joint portion 21*a* to above second distal interphalangeal joint portion 21*c* with above second proximal interphalangeal joint portion 21*b* interposed therebetween. Meanwhile, middle finger resistance portion 73 is disposed between third metacarpophalangeal joint portion 31*a* and third proximal interphalangeal joint portion 31*b*. Middle finger resistance portion 73 does not straddle third metacarpophalangeal joint portion 31*a* and third proximal interphalangeal joint portion 31*b*. Index finger resistance portion 74 is disposed near fourth metacarpophalangeal joint portion 41*a*. Index finger resistance portion 74 does not straddle fourth metacarpophalangeal joint portion 41*a*.

In this way, the number of joint portions in first joint portion 4 straddled by first resistance portion 70*a* is larger than the number of joint portions in second joint portion straddled by second resistance portion 70*b*. As illustrated in FIG. 2, the number of joint portions straddled by resistance portion 7 corresponds to the number of distortion d generated in resistance portion 7 when the wearer bends the finger. In other words, when the number of joint portions straddled by resistance portion 7 is large, bending resistance R of resistance portion 7 increases. Therefore, if the number of joint portions in first joint portion 4 straddled by first resistance portion 70*a* is larger than the number of joint portions in second joint portion 5 straddled by second resistance portion 70*b*, when the wearer bends index finger 101B4, middle finger 101B3, ring finger 101B2, and little finger 101B1 respectively received by index finger portion 40, middle finger portion 30, ring finger portion 20, and little finger portion 10, a magnitude of bending resistance R applied to little finger 101B1 or ring finger 101B2 becomes greater than a magnitude of bending resistance R applied to middle finger 101B3 or index finger 101B4.

In sports glove 1, resistance portion 7 may be disposed such that when the wearer bends index finger 101B4, middle finger 101B3, ring finger 101B2, and little finger 101B1 respectively received by index finger portion 40, middle finger portion 30, ring finger portion 20, and little finger portion 10, the magnitude of bending resistance R applied to little finger 101B1 or ring finger 101B2 is greater than the magnitude of bending resistance R applied to middle finger 101B3 or index finger 101B4. Therefore, glove 1 may not include second resistance portion 70*b*. In this way, even if the wearer bends the index finger 101B4 and middle finger 101B3 respectively received by index finger portion 40 and middle finger portion 30, the load is not applied to middle finger 101B3 or index finger 101B4 because there is no bending resistance R applied from the resistance portion to middle finger 101B3 or index finger 101B4. As a result, the magnitude of bending resistance R applied to little finger 101B1 or ring finger 101B2 becomes greater than the magnitude of bending resistance R applied to middle finger 101B3 or index finger 101B4.

From the graph illustrated in FIG. 4, it is considered that when the wearer bends the finger, if resistance portion 7 is disposed such that the load applied to ring finger 101B2 and little finger 101B1 increases in this order, a good gripping state can be realized in a case where the wearer grips the target object. For example, the number of joint portions in first joint portion 4 straddled by little finger resistance portion 71 may be larger than the number of joint portions in first joint portion 4 straddled by ring finger resistance portion 72. Specifically, little finger resistance portion 71 may be disposed on surface S of back portion 60*a* and little finger portion 10 so as to straddle each of first metacarpophalangeal joint portion 11*a*, first proximal interphalangeal joint portion 11*b*, and first distal interphalangeal joint portion 11*c*. Ring finger resistance portion 72 may be disposed on surfaces S of back portion 60*a* and the little finger portion 10 so as to straddle each of second metacarpophalangeal joint portion 21*a* and second proximal interphalangeal joint portion 21*b*. In this way, the number of joint portions in first joint portion 4 over which little finger resistance portion 71 straddles is three. The number of joint portions in first joint portion 4 straddled by ring finger resistance portion 72 is two. In other words, the number of joint portions in first joint portion 4 over which little finger resistance portion 71 straddles is larger than the number of joint portions in first joint portion 4 over which ring finger resistance portion 72 straddles. As a result, the load (bending resistance R) applied to little finger 101B1 can be made larger than the load (bending resistance R) applied to ring finger 101B2, so that the good gripping state with respect to the target object can be realized.

In sports glove 1, resistance portion 7 may be disposed such that the magnitude of bending resistance R applied to little finger 101B1 is greater than the magnitude of bending resistance R applied to ring finger 101B2 when the wearer bends the finger. Therefore, glove 1 may not include ring finger resistance portion 72. In this way, in a case where the wearer bends the finger, since there is no bending resistance R applied from ring finger resistance portion 72 to ring finger 101B2, no load is applied to ring finger 101B2. As a result, the magnitude of bending resistance R applied to little finger 101B1 is greater than the magnitude of bending resistance R applied to ring finger 101B2.

From the graph shown in FIG. 4, it is considered that in a case where the wearer bends the finger, resistance portion 7 is arranged such that the load applied to index finger 101B4 and middle finger 101B3 increases in this order, so that a good gripping state can be realized in a case where the wearer grips the target object. For example, the number of joint portions in second joint portion 5 over which middle finger resistance portion 73 straddles may be larger than the number of joint portions in second joint portion 5 over which index finger resistance portion 74 straddles. Specifically, middle finger resistance portion 73 may be disposed on surface S of back portion 60*a* and middle finger portion 30 so as to straddle each of third metacarpophalangeal joint portion 31*a* and third proximal interphalangeal joint portion 31*b*. Index finger resistance portion 74 may be disposed on surface S of back portion 60*a* a so as to straddle only fourth metacarpophalangeal joint portion 41*a*. In this way, the number of joint portions in second joint portion 5 over which middle finger resistance portion 73 straddles is two. The number of joint portions in second joint portion 5 over which index finger resistance portion 74 straddles is one. In other words, the number of joint portions in second joint portion 5 over which middle finger resistance portion 73 straddles is larger than the number of joint portions in second joint portion 5 over which index finger resistance portion 74 straddles. As a result, a good gripping state with respect to the target object can be realized.

In sports glove 1, resistance portion 7 may be disposed such that the magnitude of bending resistance R applied to middle finger 101B3 is greater than the magnitude of bending resistance R applied to index finger 101B4 when the wearer bends the finger. Therefore, glove 1 may not include index finger resistance portion 74. In this way, in a case where the wearer bends the finger, since there is no bending resistance R applied from index finger resistance portion 74 to index finger 101B4, no load is applied to index finger 101B4. As a result, the magnitude of bending resistance R applied to middle finger 101B3 is greater than the magnitude of bending resistance R applied to index finger 101B4.

In particular, it is considered that it is most preferable to arrange resistance portion 7 such that the load applied to little finger 101B1, ring finger 101B2, middle finger 101B3, and index finger 101B4 decreases in this order when the wearer bends the finger. Therefore, the number of little finger resistance portions 71, ring finger resistance portions 72, middle finger resistance portions 73, and index finger resistance portions 74 each straddle the joint portion may be reduced in this order.

Note that, a magnitude relationship of the number of joint portions straddled by each of resistance portions 7 may match a magnitude relationship of bending resistance R in each of resistance portions 7. Therefore, first resistance portion 70*a* may be disposed so as to straddle over at least one joint selected from the group consisting of first metacarpophalangeal joint portion 11*a*, first proximal interphalangeal joint portion 11*b*, first distal interphalangeal joint portion 11*c*, second metacarpophalangeal joint portion 21*a*, second proximal interphalangeal joint portion 21*b*, and second distal interphalangeal joint portion 21*c*. Second resistance portion 70*b* may be disposed on at least one joint portion selected from the group consisting of third metacarpophalangeal joint portion 31*a*, third proximal interphalangeal joint portion 31*b*, third distal interphalangeal joint portion 31*c*, fourth metacarpophalangeal joint portion 41*a*, fourth proximal interphalangeal joint portion 41*b*, and fourth distal interphalangeal joint portion 41*c*.

Rigidity EI of first resistance portion 70*a* may be larger than rigidity EI of second resistance portion 70*b*. Bending moment M generated in resistance portion 7 when the wearer bends the finger corresponds to a value obtained by multiplying the curvature by rigidity EI. For example, when rigidity EI of first resistance portion 70*a* is larger than rigidity EI of second resistance portion 70*b*, the magnitude of bending resistance R applied to little finger 101B1 or ring finger 101B2 is greater than the magnitude of bending resistance R applied to middle finger 101B3 or index finger 101B4 when the wearer bends the finger.

In addition, rigidity EI is a value obtained by multiplying second moment of area I in a cross section determined from a cross-sectional shape in an arbitrary cross section by the Young's modulus E that is a physical property value of a material. When bending resistance R in resistance portion 7 is adjusted, not only the number of joint portions straddled by resistance portion 7 but also a shape and material of resistance portion 7 may be changed.

Figure 5:
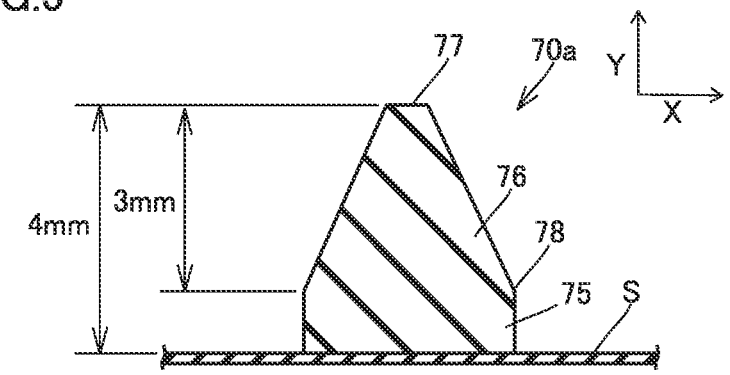
FIG. 5 is a cross-sectional view of a first resistance portion taken along a line V-V in FIG. 1.
Figure 6:
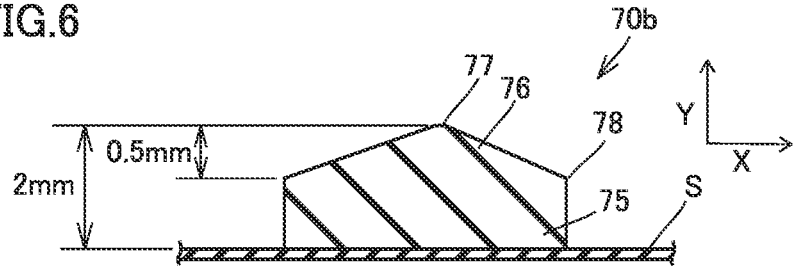
FIG. 6 is a cross-sectional view of a second resistance portion taken along line VI-VI in FIG. 1.

FIG. 5 is the cross-sectional view of first resistance portion 70*a* taken along line V-V in FIG. 1. FIG. 6 is the cross-sectional view of second resistance portion 70*b* taken along line VI-VI in FIG. 1. As illustrated in FIGS. 5 and 6, the cross-sectional shape of resistance portion 7 includes a first portion 75 and a second portion 76. First portion 75 is in contact with surface S of finger portion 3. First portion 75 has a connecting portion 78 at a position opposite to a surface connected to surface S of finger portion 3. First portion 75 is connected to second portion 76 with connecting portion 78 interposed therebetween. Second portion 76 has a top portion 77. Top portion 77 is in an opposite position relative to connecting portion 78. A cross-sectional shape of first portion 75 is a quadrangular shape. Second portion 76 has a trapezoidal cross-sectional shape.

As illustrated in FIG. 5, in first resistance portion 70*a*, a distance from surface S of finger portion 3 to top portion 77 in a Y direction is, for example, 4 mm. Meanwhile, as illustrated in FIG. 6, in second resistance portion 70*b*, a distance from surface S of finger portion 3 to top portion 77 in the Y direction is, for example, 2 mm. In other words, a distance from surface S of finger portion 3 to top portion 77 in first resistance portion 70*a* is longer than a distance from surface S of finger portion 3 to top portion 77 in second resistance portion 70*b*. Therefore, each of section modulus Z and second moment of area I of first resistance portion 70*a* in the cross section illustrated in FIG. 5 is larger than section modulus Z and second moment of area I of second resistance portion 70*b* in the cross section illustrated in FIG. 6. In this way, bending resistance R of first resistance portion 70*a* is greater than bending resistance R of second resistance portion 70*b*.

The cross-sectional shape of first resistance portion 70*a* illustrated in FIG. 5 and the cross-sectional shape of second resistance portion 70*b* illustrated in FIG. 6 may be any shape. For example, a width of first resistance portion 70*a* in an X direction shown in FIG. 5 may be larger than a width of second resistance portion 70*b* in the X direction shown in FIG. 6. Note that, a magnitude relationship between section modulus Z and second moment of area I of each of resistance portions 7 may be matched with a magnitude relationship of bending resistance R of each of resistance portions 7. The cross-sectional shape of each of little finger resistance portion 71, ring finger resistance portion 72, middle finger resistance portion 73, and index finger resistance portion 74 may be appropriately changed.

The material of resistance portion 7 in the present embodiment is, for example, silicon resin. Since resistance portion 7 only needs to have flexibility, the material of resistance portion 7 may be, for example, natural leather, synthetic leather, artificial leather, knit material, urethane, silicon rubber, rubber, or the like. The materials of first resistance portion 70*a* and second resistance portion 70*b* may be the same material or different materials. Bending moment M generated in resistance portion 7 when the wearer bends the finger also depends on the Young's modulus E of the material of resistance portion 7. Therefore, in a case where the material of first resistance portion 70*a* and the material of second resistance portion 70*b* are different from each other, for example, the material of first resistance portion 70*a* may be natural leather, and the material of second resistance portion 70*b* may be the knit material. The Young's modulus E of the natural leather is larger than the Young's modulus E of the knit material. In this way, rigidity EI of first resistance portion 70*a* is larger than rigidity EI of second resistance portion 70*b*.

Since rigidity EI of first resistance portion 70*a* only needs to be larger than rigidity EI of second resistance portion 70*b*, the respective materials of little finger resistance portion 71, ring finger resistance portion 72, middle finger resistance portion 73, and index finger resistance portion 74 may be appropriately changed so that rigidity EI of first resistance portion 70*a* is larger than rigidity EI of second resistance portion 70*b*. Note that, the Young's modulus E can be measured by performing a tensile test of a target material.

Operation and Effect

Sports glove 1 according to the present disclosure includes index finger portion 40, middle finger portion 30, ring finger portion 20, little finger portion 10, back portion 60*a*, and first resistance portion 70*a*. Index finger portion 40, middle finger portion 30, ring finger portion 20, and little finger portion 10 can respectively receive index finger 101B4, middle finger 101B3, ring finger 101B2, and little finger 101B1 of the wearer's hand. Back portion 60*a* is connected to index finger portion 40, middle finger portion 30, ring finger portion 20, and little finger portion 10. Back portion 60*a* covers back 101A of the wearer's hand. First resistance portion 70*a* has flexibility. First resistance portion 70*a* is disposed on at least one selected from the group consisting of back portion 60*a*, ring finger portion 20, and little finger portion 10 such that when the wearer bends index finger 101B4, middle finger 101B3, ring finger 101B2, and little finger 101B1 respectively received by index finger portion 40, middle finger portion 30, ring finger portion 20, and little finger portion 10, the magnitude of bending resistance R applied to little finger 101B1 or ring finger 101B2 is greater than the magnitude of bending resistance R applied to middle finger 101B3 or index finger 101B4.

In this way, when the wearer bends the finger, the magnitude of bending resistance R applied to little finger 101B1 or ring finger 101B2 is greater than the magnitude of bending resistance R applied to middle finger 101B3 or index finger 101B4. As a result, the wearer can consciously grip the target object with little finger 101B1 and ring finger 101B2 with a weak finger force, so that a good gripping state can be realized with respect to the target object. For example, in a case where the target object to be gripped is a baseball bat 200, since the gripping state of bat 200 is good and the operability is improved, the wearer can improve the swing speed of bat 200. In addition, by providing resistance portion 7, it is also possible to suppress generation of slack and wrinkles in palm portion 60*b*.

Sports glove 1 further includes second resistance portion 70*b*. Second resistance portion 70*b* has flexibility. Second resistance portion 70*b* is disposed on at least one selected from the group consisting of back portion 60*a*, middle finger portion 30, and index finger portion 40. When the wearer bends index finger 101B4, middle finger 101B3, ring finger 101B2, and little finger 101B1 respectively received by index finger portion 40, middle finger portion 30, ring finger portion 20, and little finger portion 10, the magnitude of bending resistance R applied to little finger 101B1 or ring finger 101B2 by first resistance portion 70*a* is greater than the magnitude of bending resistance R applied to middle finger 101B3 or index finger 101B4 by second resistance portion 70*b*. In this way, by providing second resistance portion 70*b*, the magnitude of bending resistance R applied to index finger 101B4 and middle finger 101B3 can be individually adjusted.

In sports glove 1, first resistance portion 70*a* includes little finger resistance portion 71. Little finger resistance portion 71 is disposed on at least one of back portion 60*a* and little finger portion 10 such that when the wearer bends index finger 101B4, middle finger 101B3, ring finger 101B2, and little finger 101B1 respectively received by index finger portion 40, middle finger portion 30, ring finger portion 20, and little finger portion 10, the magnitude of bending resistance R applied to little finger 101B1 becomes greater than or equal to the magnitude of bending resistance R applied to ring finger 101B2. In this way, when the wearer bends the finger, the magnitude of bending resistance R applied to little finger 101B1 is greater than the magnitude of bending resistance R applied to ring finger 101B2.

In sports glove 1, first resistance portion 70*a* further includes ring finger resistance portion 72. Ring finger resistance portion 72 is disposed on at least one of back portion 60*a* and ring finger portion 20. When the wearer bends index finger 101B4, middle finger 101B3, ring finger 101B2, and little finger 101B1 respectively received by index finger portion 40, middle finger portion 30, ring finger portion 20, and little finger portion 10, the magnitude of bending resistance R applied to little finger 101B1 by little finger resistance portion 71 becomes greater than or equal to the magnitude of bending resistance R applied to ring finger 101B2 by ring finger resistance portion 72. In this way, by providing ring finger resistance portion 72, the magnitude of bending resistance R applied to ring finger 101B2 and little finger 101B1 can be individually adjusted.

In sports glove 1, second resistance portion 70*b* includes middle finger resistance portion 73. Middle finger resistance portion 73 is disposed on at least one of the back portion 60*a* and middle finger portion 30 such that when the wearer bends index finger 101B4, middle finger 101B3, ring finger 101B2, and little finger 101B1 respectively received by index finger portion 40, middle finger portion 30, ring finger portion 20, and little finger portion 10, the magnitude of bending resistance R applied to middle finger 101B3 is greater than the magnitude of bending resistance R applied to index finger 101B4. In this way, when the wearer bends the finger, the magnitude of bending resistance R applied to middle finger 101B3 is greater than the magnitude of bending resistance R applied to index finger 101B4.

In sports glove 1, second resistance portion 70*b* further includes index finger resistance portion 74. Index finger resistance portion 74 is disposed on at least one of back portion 60*a* and index finger portion 40. When the wearer bends index finger 101B4, middle finger 101B3, ring finger 101B2, and little finger 101B1 respectively received by index finger portion 40, middle finger portion 30, ring finger portion 20, and little finger portion 10, the magnitude of bending resistance R applied to middle finger 101B3 by middle finger resistance portion 73 is greater than the magnitude of bending resistance R applied to index finger 101B4 by index finger resistance portion 74. In this way, by providing index finger resistance portion 74, the magnitude of bending resistance R applied to middle finger 101B3 and index finger 101B4 can be individually adjusted.

In sports glove 1, back portion 60*a*, ring finger portion 20, and little finger portion 10 include first joint portion 4. First joint portion 4 includes first metacarpophalangeal joint portion 11*a*, second metacarpophalangeal joint portion 21*a*, first proximal interphalangeal joint portion 11*b*, first distal interphalangeal joint portion 11*c*, second proximal interphalangeal joint portion 21*b*, and second distal interphalangeal joint portion 21*c*. First metacarpophalangeal joint portion 11*a* covers metacarpophalangeal joint 123 of little finger 101B1 of the wearer's hand. Second metacarpophalangeal joint portion 21*a* covers metacarpophalangeal joint 123 of ring finger 101B2 of the wearer's hand. First proximal interphalangeal joint portion 11*b* covers proximal interphalangeal joint 122 of little finger 101B1 of the wearer's hand. First distal interphalangeal joint portion 11*c* covers distal interphalangeal joint 121 of little finger 101B1 of the wearer's hand. Second proximal interphalangeal joint portion 21*b* covers proximal interphalangeal joint 122 of ring finger 101B2 of the wearer's hand. Second distal interphalangeal joint portion 21*c* covers distal interphalangeal joint 121 of ring finger 101B2 of the wearer's hand. First resistance portion 70*a* is disposed so as to straddle over at least one joint portion selected from the group consisting of first metacarpophalangeal joint portion 11*a*, first proximal interphalangeal joint portion 11*b*, first distal interphalangeal joint portion 11*c*, second metacarpophalangeal joint portion 21*a*, second proximal interphalangeal joint portion 21*b*, and second distal interphalangeal joint portion 21*c*. Back portion 60*a*, index finger portion 40, and middle finger portion 30 include a second joint portion 5. Second joint portion 5 includes third metacarpophalangeal joint portion 31*a*, fourth metacarpophalangeal joint portion 41*a*, third proximal interphalangeal joint portion 31*b*, third distal interphalangeal joint portion 31*c*, fourth proximal interphalangeal joint portion 41*b*, and fourth distal interphalangeal joint portion 41*c*. Third metacarpophalangeal joint portion 31*a* covers metacarpophalangeal joint 123 of middle finger 101B3 of the wearer's hand. Fourth metacarpophalangeal joint portion 41*a* covers metacarpophalangeal joint 123 of index finger 101B4 of the wearer's hand. Third proximal interphalangeal joint portion 31*b* covers proximal interphalangeal joint 122 of middle finger 101B3 of the wearer's hand. Third distal interphalangeal joint portion 31*c* covers distal interphalangeal joint 121 of middle finger 101B3 of the wearer's hand. Fourth proximal interphalangeal joint portion 41*b* covers proximal interphalangeal joint 122 of index finger 101B4 of the wearer's hand. Fourth distal interphalangeal joint portion 41*c* covers distal interphalangeal joint 121 of index finger 101B4 of the wearer's hand. Second resistance portion 70*b* is disposed on at least one joint portion selected from the group consisting of a third metacarpophalangeal joint portion 31*a*, third proximal interphalangeal joint portion 31*b*, third distal interphalangeal joint portion 31*c*, fourth metacarpophalangeal joint portion 41*a*, fourth proximal interphalangeal joint portion 41*b*, and fourth distal interphalangeal joint portion 41*c*. The number of joint portions in first joint portion 4 straddled by first resistance portion 70*a* is larger than the number of joint portions in second joint portion straddled by second resistance portion 70*b*.

In this way, the magnitude of bending resistance R applied to little finger 101B1 or ring finger 101B2 by first resistance portion 70*a* is greater than the magnitude of bending resistance R applied to middle finger 101B3 or index finger 101B4 by second resistance portion 70*b*.

In sports glove 1, rigidity EI of first resistance portion 70*a* is larger than rigidity EI of second resistance portion 70*b*. In this way, the magnitude of bending resistance R applied to little finger 101B1 or ring finger 101B2 by first resistance portion 70*a* is greater than the magnitude of bending resistance R applied to middle finger 101B3 or index finger 101B4 by second resistance portion 70*b*.

In sports glove 1, first resistance portion 70*a* has a shape having second moment of area I larger than second moment of area I of second resistance portion 70*b*. In this way, the magnitude of bending resistance R applied to little finger 101B1 or ring finger 101B2 by first resistance portion 70*a* is greater than the magnitude of bending resistance R applied to middle finger 101B3 or index finger 101B4 by second resistance portion 70*b*.

In sports glove 1, the Young's modulus E of the material of first resistance portion 70*a* is larger than the Young's modulus E of second resistance portion 70*b*. In this way, the magnitude of bending resistance R applied to little finger 101B1 or ring finger 101B2 by first resistance portion 70*a* is greater than the magnitude of bending resistance R applied to middle finger 101B3 or index finger 101B4 by second resistance portion 70*b*.

In order to confirm effectiveness of sports glove 1 according to the present embodiment as described above, the following swing test was performed.

Figure 7:
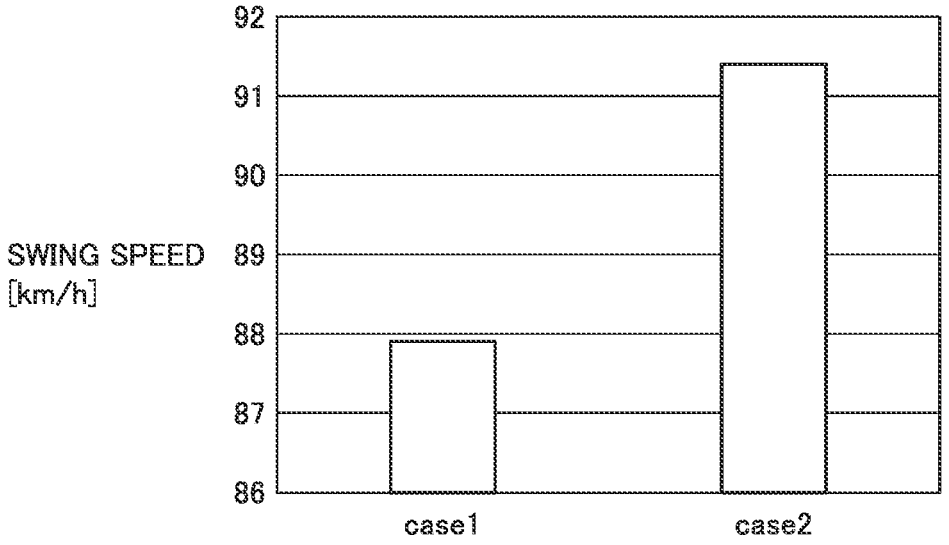
FIG. 7 is a graph showing a swing speed of a bat by an adult male.
Figure 8:
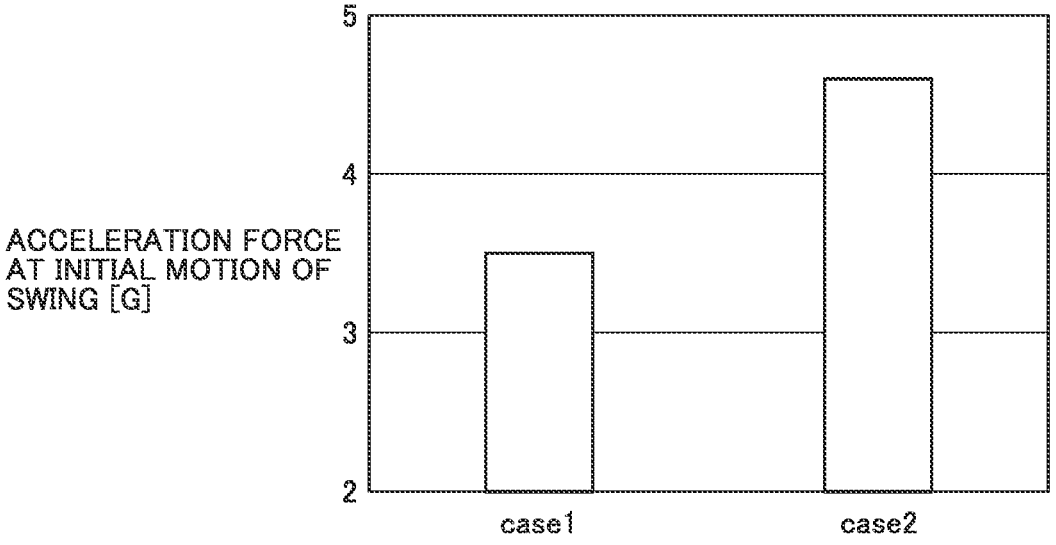
FIG. 8 is a graph showing an acceleration force of the bat at an initial motion of swing of the bat by the adult male.

FIG. 7 is the graph showing the swing speed of bat 200 by an adult male. In FIG. 7, the vertical axis represents the swing speed (unit: km/h) of bat 200. FIG. 8 is the graph showing the acceleration force of bat 200 at the initial motion of the swing of bat 200 by the adult male. In FIG. 8, the vertical axis represents an acceleration force (unit: G) of bat 200. A unit G indicates gravitational acceleration. Case 1 is a measurement result when an adult male grips bat 200 only with index finger 101B4 and middle finger 101B3. Case 2 is a measurement result when the adult male grips bat 200 only with ring finger 101B2 and little finger 101B1. Note that, data shown in FIGS. 7 and 8 described above were measured using BlastBaseball manufactured by Blast.

As can be seen from FIG. 7, the swing speed in case 2 is larger than the swing speed in case 1. As can be seen from FIG. 8, the acceleration force of bat 200 in case 2 is larger than the acceleration force of bat 200 in case 1. From this, it is considered that the swing speed of bat 200 can be increased by increasing the acceleration force of bat 200 at the initial motion of the swing. In other words, the swing speed is improved when bat 200 is gripped only with ring finger 101B2 and little finger 101B1 than when bat 200 is gripped only with index finger 101B4 and middle finger 101B3. From this, it is considered that reliably gripping bat 200 with ring finger 101B2 and little finger 101B1 greatly contributes to improvement of the swing speed.

Figure 9:
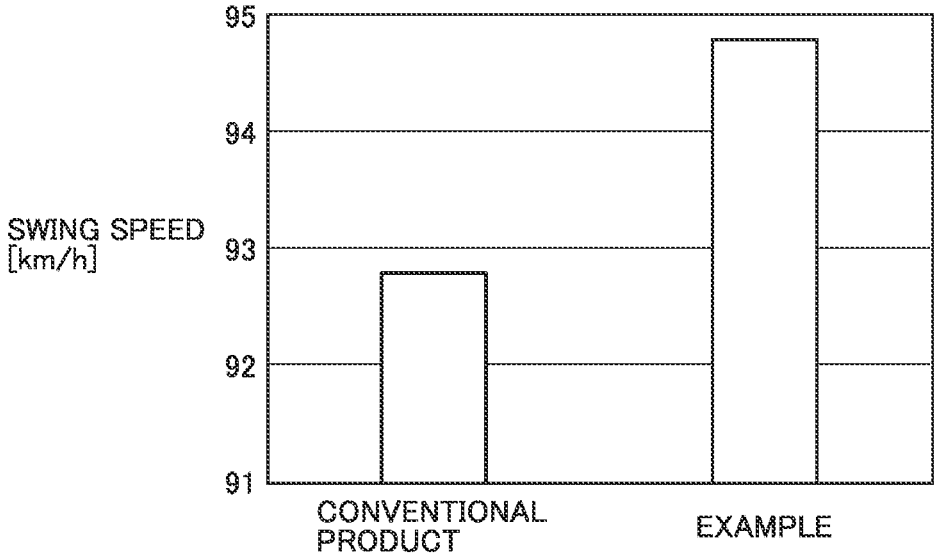
FIG. 9 is a graph showing the swing speed of the bat by an adult male.
Figure 10:
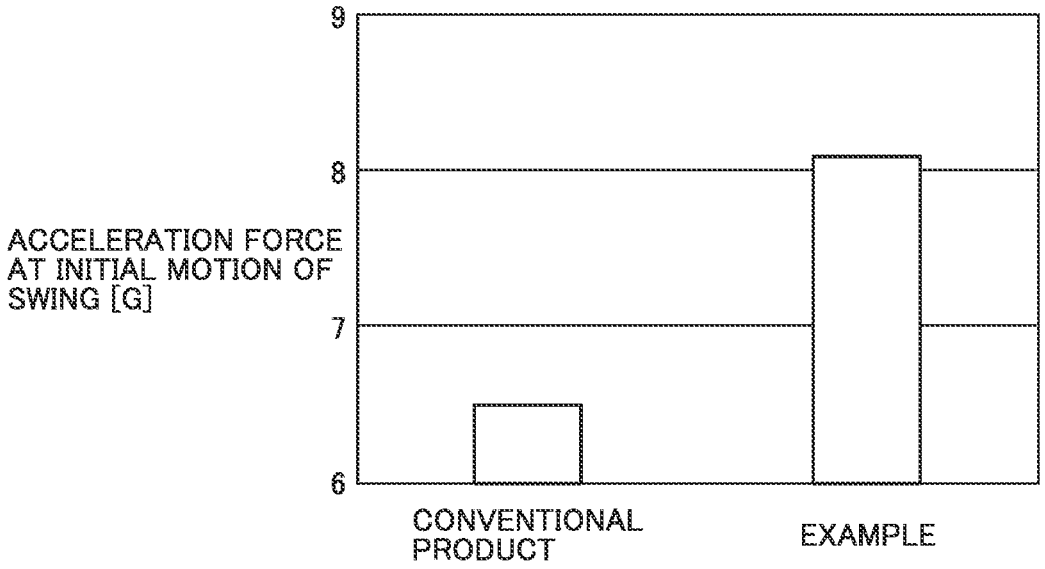
FIG. 10 is a graph showing an acceleration force of the bat at the initial motion of swing of the bat by the adult male.

FIG. 9 is the graph showing the swing speed of bat 200 by an adult male. In FIG. 9, the vertical axis represents the swing speed of bat 200. FIG. 10 is a graph illustrating the acceleration force of bat 200 at the initial motion of the swing of bat 200 by the adult male. In FIG. 10, the vertical axis represents the acceleration force of bat 200. In the horizontal axes of FIGS. 9 and 10, "conventional product" indicates a case where the bat is swung while wearing gloves in which bending resistances R of index finger portion 40, middle finger portion 30, ring finger portion 20, and little finger portion 10 are equal to each other. "Example" is glove 1 shown in FIG. 1, in which bending resistance R of each of middle finger portion 30, ring finger portion 20, and little finger portion 10 is greater than bending resistance R of index finger portion 40. Note that, the data measurement method illustrated in FIGS. 9 and 10 is similar to the data measurement method illustrated in FIGS. 7 and 8.

As can be seen from FIG. 9, the swing speed by the adult male wearing glove 1 of the example is larger than the swing speed by the adult male wearing glove 1 of the conventional product. As can be seen from FIG. 10, the acceleration force of bat 200 by the adult male wearing glove 1 of the example is larger than the acceleration force of bat 200 by the adult male wearing the conventional glove 1. As described above, in FIGS. 9 and 10, a tendency as seen in FIGS. 7 and 8 can be confirmed. In other words, the effectiveness in glove 1 of the embodiment in which resistance portion 7 is arranged such that the magnitude of bending resistance R applied to little finger 101B1 or ring finger 101B2 is greater than the magnitude of bending resistance R applied to middle finger 101B3 or index finger 101B4 was confirmed.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A sports glove comprising:

an index finger portion, a middle finger portion, a ring finger portion, and a little finger portion capable of respectively receiving an index finger, a middle finger, a ring finger, and a little finger of a hand of a wearer;

a back portion connected to the index finger portion, the middle finger portion, the ring finger portion, and the little finger portion and configured to cover a back of the wearer's hand; and a first resistance portion having flexibility comprising at least one of a little finger resistance portion or a ring finger resistance portion, wherein the first resistance portion is disposed on the back portion and on at least one of the ring finger portion or the little finger portion such that when the wearer bends the index finger, the middle finger, the ring finger, and the little finger respectively received by the index finger portion, the middle finger portion, the ring finger portion, and the little finger portion, a magnitude of bending resistance applied to the little finger or the ring finger is greater than a magnitude of bending resistance applied to the middle finger or the index finger, and wherein the number of joint portions over which at least one of the little finger resistance portion or the ring finger resistance portion straddle is larger than the number of joint portions over which a middle finger resistance portion and an index finger resistance portion straddle.

2. The sports glove according to claim 1, further comprising a second resistance portion having flexibility, wherein the second resistance portion is disposed on the back portion and on at least one selected from the middle finger portion or the index finger portion, and when the wearer bends the index finger, the middle finger, the ring finger, and the little finger respectively received by the index finger portion, the middle finger portion, the ring finger portion, and the little finger portion, the magnitude of bending resistance applied to the little finger or the ring finger by the first resistance portion is greater than a magnitude of bending resistance applied to the middle finger or the index finger by the second resistance portion.

3. The sports glove according to claim 2, wherein the little finger resistance portion is disposed on the back portion and the little finger portion such that when the wearer bends the index finger, the middle finger, the ring finger, and the little finger respectively received by the index finger portion, the middle finger portion, the ring finger portion, and the little finger portion, the magnitude of bending resistance applied to the little finger is greater than or equal to a magnitude of bending resistance applied to the ring finger.

4. The sports glove according to claim 3, wherein the ring finger resistance portion is disposed on the back portion and the ring finger portion, and when the wearer bends the index finger, the middle finger, the ring finger, and the little finger respectively received by the index finger portion, the middle finger portion, the ring finger portion, and the little finger portion, the magnitude of bending resistance applied to the little finger by the little finger resistance portion is greater than or equal to a magnitude of bending resistance applied to the ring finger by the ring finger resistance portion.

5. The sports glove according to claim 1, wherein a length of the middle finger resistance portion is smaller than a length of the little finger resistance portion and the ring finger resistance portion.

* * * * *